US008882379B2

(12) United States Patent
Jackson

(10) Patent No.: US 8,882,379 B2
(45) Date of Patent: Nov. 11, 2014

(54) SUNTAN OIL APPLICATOR

(75) Inventor: Cedrick Lebron Jackson, Chattanooga, TN (US)

(73) Assignee: Cedrick L. Jackson, Chattanooga, TN (US)

( * ) Notice: Subject to any disclaimer, the term of this patent is extended or adjusted under 35 U.S.C. 154(b) by 434 days.

(21) Appl. No.: 13/317,345

(22) Filed: Oct. 14, 2011

(65) Prior Publication Data

US 2013/0094894 A1 Apr. 18, 2013

(51) Int. Cl.

| | |
|---|---|
| ***A46B 5/02*** | (2006.01) |
| ***A45D 34/04*** | (2006.01) |
| ***A46B 11/00*** | (2006.01) |
| ***A46B 9/00*** | (2006.01) |

(52) U.S. Cl.

CPC ..... *A45D 34/04* (2013.01); *A46B 11/001* (2013.01); *A46B 9/005* (2013.01)

USPC ..... 401/6; 401/140

(58) Field of Classification Search

CPC ..... A45D 34/041; A45D 34/042; A45D 2200/1018; A45D 2200/1081; A61M 35/00

USPC ..... 401/6, 202, 203, 207, 183, 262, 266, 401/289

See application file for complete search history.

(56) References Cited

U.S. PATENT DOCUMENTS

| | | | | |
|---|---|---|---|---|
| 5,240,339 | A * | 8/1993 | DeForest et al. | 401/207 |
| 5,353,819 | A | 10/1994 | Kahn et al. | |
| 5,419,646 | A * | 5/1995 | Taylor | 401/21 |
| 5,823,206 | A | 10/1998 | Mapleback | |
| 5,842,488 | A | 12/1998 | Belleau et al. | |
| 5,851,077 | A * | 12/1998 | Trejo | 401/6 |
| 6,009,887 | A | 1/2000 | Hertel | |
| 6,017,162 | A | 1/2000 | Call | |
| 6,026,535 | A | 2/2000 | Lankowski | |
| 6,325,564 | B1 | 12/2001 | Knowles | |
| 6,438,787 | B1 | 8/2002 | Young | |
| 6,491,463 | B1 | 12/2002 | Richard | |
| 6,550,996 | B1 | 4/2003 | Rayfield | |
| 6,632,195 | B1 * | 10/2003 | Smith | 604/36 |
| 6,726,385 | B1 | 4/2004 | Borowski | |
| 2001/0034920 | A1 | 11/2001 | Brown | |
| 2001/0053305 | A1 | 12/2001 | Berke et al. | |
| 2002/0018687 | A1 | 2/2002 | Owings | |
| 2002/0172540 | A1 | 11/2002 | Hauser et al. | |
| 2005/0019086 | A1 | 1/2005 | Haneda | |

* cited by examiner

*Primary Examiner* — David Walczak
*Assistant Examiner* — Jennifer C Chiang

(57) ABSTRACT

An applicator device for applying oil or lotion to hard to reach areas of the body. The applicator comprises a hollow elongated body allowing the flow of fluid there through. The elongated body includes an upper and lower portions hingedly connected at the midpoint, thereby forming an elbow with a spring coupling. A coaxial flexible tube is disposed within the hollow elongated body for connecting the upper and lower portions. The distal end of the lower portion of the applicator attaches to the neck of a bottle (e.g. sun tan oil bottle). The distal end of the upper portion of the applicator includes a convex sponge. When the applicator is attached to a bottle, the bottle may be squeezed to force oil through the coaxial flexible tube and out through the pores of the convex sponge for spreading lotion onto a user's skin.

5 Claims, 4 Drawing Sheets

SUNTAN OIL APPLICATOR

TECHNICAL FIELD

The present invention relates to the devices used to apply and spread oil or lotion onto the skin of a user, especially suntan oil or lotion.

BACKGROUND OF THE INVENTION

Application of lotion on one's back can be very difficult for various reasons. The general health, age, and bodily flexibility of a user will determine whether the user is capable of spreading lotion on all of the desired parts of the body. In some situations a user may require the help of another individual. However, depending on the location, such as a pool side or the beach, enlisting the help of others to apply lotions or oils such as suntan lotion may be necessary. Various lotion bottles contain applicators or spreaders, but are inadequate for application to a user's back.

DESCRIPTION OF THE RELATED ART

U.S. Pat. No. 6,632,195 for VERSATILE ADJUSTABLE LIQUID APPLICATOR by Smith which issued on Oct. 14, 2005, teaches a liquid applicator comprising a hinged tube with a threaded connector on one end and an applicator pad. U.S. Pat. No. 6,026,535 for TOPICAL SOLUTION APPLICATION APPARATUS by Lankowski issued on Feb. 22, 2000 teaches a foldable applicator including an applicator pad. When folded in a non-use condition, the pad is held in a protective cup.

SUMMARY OF THE INVENTION

In accordance with the present invention, there is provided a suntan lotion applicator comprising an elongated frame having a lower body portion and a second upper body portion hingedly connecting thereto including an applicator head attached to the distal end thereof. The lower body portion includes a means for connecting to a neck of a bottle such as an internal threaded collar portion correspondingly sized to fit an externally threaded neck opening of a lotion bottle. The distal end of the lower body portion may be comprised of an elastic or pliable material permitting limited stretching or expansion in order to fit over the neck of a bottle. An elastic collar or sleeve may also extend from the distal end of the lower portion for connecting to the neck of a bottle. At least one embodiment of the applicator includes a hook extending from a central portion of the elongated applicator body. The lower body portion includes a port, defining a spout or a nipple extending from a central portion which is in fluid communication with the lotion supply reservoir in the lower body portion. The tube or hose extends from and is in fluid communication with a cavity formed in the interior of the lower body portion and extends to the interior of the upper body portion. The conduit formed by the lower body portion, upper body portion and the hinged portion forming an elbow connecting same is capable of supplying lotion from a lotion bottle to the nipple, nipple port or to the applicator head extending from the distal end of the applicator. Fluid can flow through the elbow hose whenever the hinged elbow is in the open of folded closed position. The lower body portion also includes a cap hingedly connected utilizing a living hinge to the lower body portion which is capable of closing and sealing the nipple via a threaded connection or friction fit. A spring coupling means such as a helical spring extends from and is fixedly attached to the distal end of the lower portion of the elongated applicator body. The spring coupling comprising a helical spring is fixedly attached to the end of the upper and lower body portions. The lotion supply hose extends from the reservoir of the lower portion of the elongated body and passes through the helical spring and to connect to the reservoir in the upper elongated body portion and the applicator head.

The applicator head includes a base plate including a convex or domed shaped sponge affixed to the interior surface thereof whereby the sponge is composed of a synthetic material such as a cellular foam covered by a smooth cover of synthetic material composed of a soft plastic, rubber, or elastomeric material or an integral smooth cover formed of the sponge material itself. The sponge is surrounded by a spreader comprising an elongated rounded ridge extending around the periphery of the sponge. The spreader does not absorb lotion but provides a smooth applicator surface and aids in distribution of the lotion. The base sponge may be porous and/or has at least one aperture and preferably a pair of apertures formed therein which is in fluid communication with the elongated lotion supplying cavity of the upper reservoir which is in fluid communication with the hose and lotion supplying cavity of the lower reservoir. The preferred embodiment uses an elongated plastic spreader extending along the edge of the applicator base plate and having an oval or semi circular cross sectional shape providing a smooth surface that surrounds the sponge to supply the lotion to the skin. The polymer or synthetic coating on the sponge has a soft and smooth surface providing a no mess applicator without the complications associated with conventional cellular foam sponges having a porous or rough and uneven surface. Furthermore, a least one and preferably two holes are located in the sponge and spreader cover to allow the lotion to pass through and lubricate the spreader cover and sponge for application to the skin of the user. The use of a spreader cover on the hinged applicator cap correspondingly shaped and sized to accept the spreader of the sponge enables the spreader and spreader cover to seal the sponge and upon closing of the clamshell applicator so that the spreader and sponge are protected from particles and dirt so it will stay clean and ready to use.

The hinged applicator top cover contains sealing and holding means comprising plugs projecting from an interior surface of the applicator hinged cover capable of sealing the holes or apertures of the lotion conduits formed within the base sponge to prevent leaking of the lotion when the applicator base and cap are in the closed position. Moreover the plugs fit tightly into the corresponding holes to seal and prevent seepage of the lotion or oil and hold the cover in a tight closed position so that squeezing of the lower body portion of the applicator will permit lotion or oil to be squeezed out through the hand nipple, but not through the applicator head.

It is contemplated that means for holding the hinged cover in an open position during an in use position of the applicator head may be provided by friction or the tight hinge of the cover and base of the applicator. However, a hook and loop fastener such as VELCRO or a projection and depression arrangement defining a ball socket may be formed in or attached to the outside top surface of the cover and outside bottom surface of the base to hold the cover in a fully open position during use.

The spreader cover surrounds the marginal edge of the convex shaped sponge. The base plate has a groove formed in the rim inside the periphery of the spreader to accommodate excess oil flowing from the sponge upon closing the applicator head. The clamshell design of the applicator cover hingedly attached to a distal marginal edge of the base plate protects the spreader from dirt and particles and keeps it clean when not in use. The groove and rim of the applicator cover and base plate provides an oil seal which will surround the sponge so that when the cover is closed the seal is filled with the excess lotion and stops oil form leaking from the applicator head. The sealing means may also include a rim forming a tongue at the inside peripheral edge configured to mate with the a groove to form a liquid tight seal when the applicator head cover is held tightly against the applicator base plate containing the sponge and spreader. It is anticipated that an optional type of oil seal may utilize a pair of mating grooves in the base and cover marginal edge to contain an "O-ring" type of seal there between.

The applicator head cover may as an option include means for fastening such as a snap arrangement comprising a ball which extends outward from the distal marginal edge for cooperative connection to a pair of projections defining a hinge. The upper body has a loop or spaced apart projections extending from an edge of a central portion which is capable of having the ball snapped into the loop for fixedly holding the cover against the base plate.

A hook may also be included extending from a central position on the upper body which is capable of capturing the loop for holding the applicator in a folded storage configuration.

It is an object of this invention to provide a lotion applicator which includes a convex rubber coated soft sponge.

It is an object of this invention to provide a lotion applicator wherein a rubber or polymer coated sponge is surrounded by a plastic spreader to allow a no mess application of lotion and wherein the smooth spreader surface does not absorb or hold oil or lotion.

It is an object of this invention to provide a lotion applicator which includes a tongue and groove type seal which captures and holds any oil or lotion left on the sponge when the cover is close against the base plate holding the sponge providing quick, easy and tidy storage of the applicator.

It is an object of this invention to provide a lotion applicator which includes a two part separable longitudinal body which is urged together at the two connecting ends by a spring and which includes a hose which carries lotion from a proximal end connected to a lotion bottle to a distal end containing a sponge applicator head.

It is an object of this invention to provide a lotion applicator which includes a hinged two part applicator head which can be closed to protect the applicator sponge and which plugs and simultaneously seals off the applicator sponge apertures during storage.

It is an object of this invention to provide a lotion applicator which includes a thermometer thus allowing a user to always know the temperature.

It is an object of this invention to provide a lotion applicator which includes a upper lotion dispensing nipple which can be uncapped to dispense lotion into a user's hand while the sponge apertures are closed and sealed off.

It is another object of the present invention to provide a spring coupling means linking the upper portion and lower portion of the elongated body of the applicator wherein the spring is flexible.

It is another object of the present invention to provide a spring coupling means linking the upper portion and lower portion of the elongated body of the applicator wherein the spring is flexible and positionable whereby the spring can be bent at a desired angle in any direction.

It is another object of the present invention to include arch supports extending from distal ends of the lower portion to the upper portion, from the distal end of the upper portion to the lower portion, or a should projecting from either one or both the upper of lower portion of the elongated body cooperatively engaging one another or abutting one another providing structural support to the spring coupling means.

It is another object of the present invention to provide an elongated lotion applicator which can be removably attached to a container or bottle of lotion via a threaded connection or friction fit.

It is another object of the present invention to provide an optional expandable and/or elastic sleeve which will stretch enough to fit over a threaded or nonthreaded neck of a lotion bottle.

It is another object of the present invention to provide a hinged elongated lotion applicator including a hollow body forming a handle and angled extension supporting a applicator head and a reservoir to contain lotion.

More particularly the present invention comprises, consist essentially of or consists of a lotion applicator consisting of a lower body portion having a hollow interior defining a lower conduit hingedly connecting to an upper body portion having a hollow interior defining an upper conduit and having an applicator head extending therefrom. A tube connects a lower conduit to the upper conduit. A helical spring coupling extends from and connecting the lower body portion to the upper body portion for positioning the upper body portion at a selected obtuse angle of less than 170 degrees with respect to the lower body portion. The tube extends coaxially through the helical spring coupling. The applicator head includes a base plate having a base sponge having a smooth surface, the base sponge having at least one aperture formed therein in fluid communication with the upper conduit. The applicator head includes a spreader extending around the marginal edge of at least a portion of the base plate. The spreader consists essentially of an elongated raised ridge having a smooth rounded cross-sectional area. The applicator base includes a groove around the periphery thereof disposed between the sponge and the spreader. The applicator head includes a cover cap hingedly attached to a distal marginal edge of the base plate, the covercap including a rim forming a tongue around the peripheral edge thereof, the tongue of a corresponding size and shape to cooperatively engage the ridge of the base plate forming a leak tight seal when the cover cap is closed against the base plate of the applicator head. The cover includes a pair of snap lock balls extending from a distal marginal edge thereof. The upper body has a loop extending from a central portion thereof capable of having the ball snapped there into for fixedly holding the cover against the base plate for releaseably engaging a corresponding snap ball projecting from a marginal edge of the base plate. The cover contains at least one mating plug capable of sealing engagement with at least one aperture within the base sponge for holding the lotion within the aperture upon closure of the cap with the base plate. The upper body portion has a ball receiving socket on an exterior surface side opposite to the base sponge and the cover has a ball extending outward from an exterior surface side opposite to the at least one plug. The ball is positioned to snap into the socket upon rotating the cover on the hinge for holding the cover in a fully open position. The lower body portion includes a means of attachment to a neck of a bottle such as an expandable collar, a threaded collar, or a collar formed having a tapering internal diameter providing a leak proof friction fit with the neck of a bottle. The lower body portion includes a lower loop extending from a selected position. The upper body portion includes a hook extending from a selected position for releaseably engaging the lower loop capable of capturing the hook for holding the applicator in a folded storage configuration. The lower body portion includes a nipple extending from a selected position thereof in fluid communication with the lower conduit and a cap hingedly connecting the lower body portion for closing and sealing the nipple.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

In accordance with the present invention, there is provided a lotion applicator for applying and spreading lotion, especially suntan lotion, to hard to reach areas of a user's body. It is understood that the present invention is useful for applying both lotion and oil to a user's skin and therefore, the terms 'oil' and 'lotion' will be used interchangeably.

Figure 1:
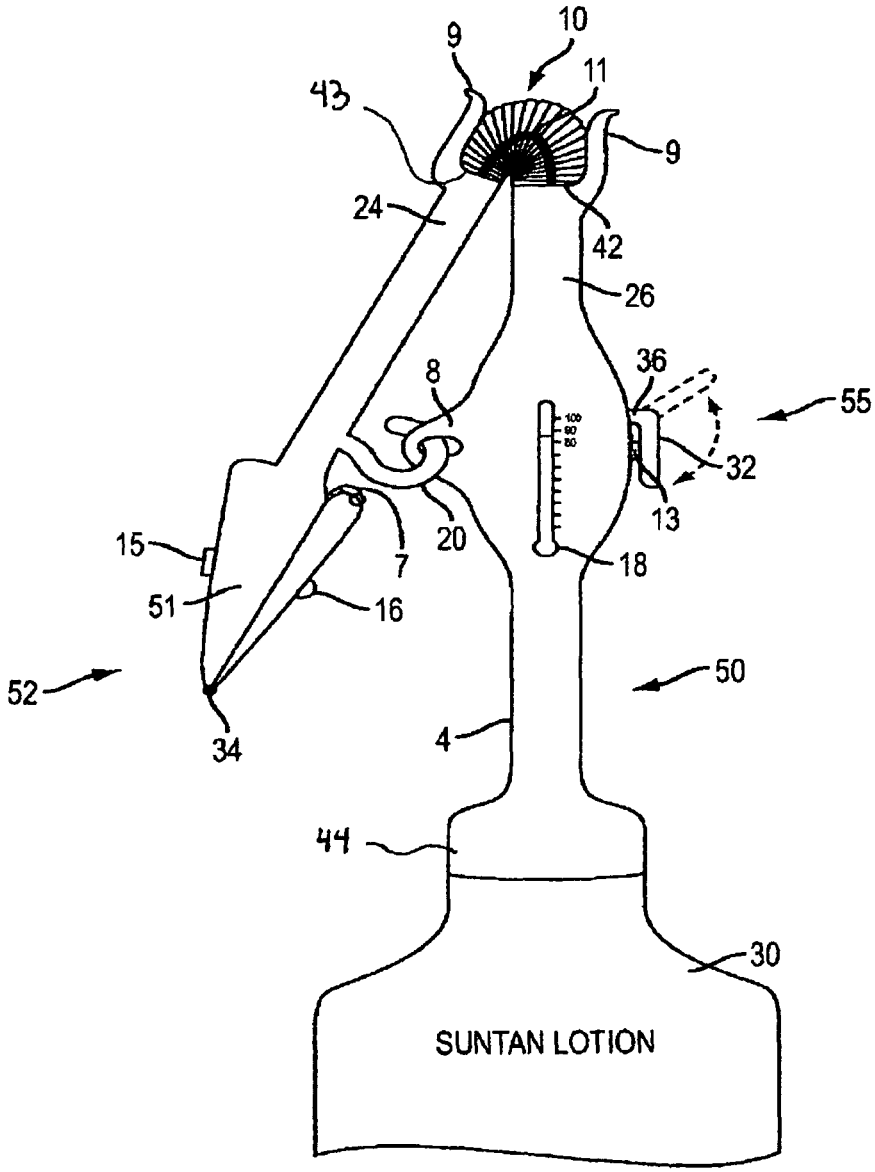
FIG. 1 is a side view of the suntan oil applicator folded into a space saving collapsed configuration connected to a lotion bottle.
Figure 2:
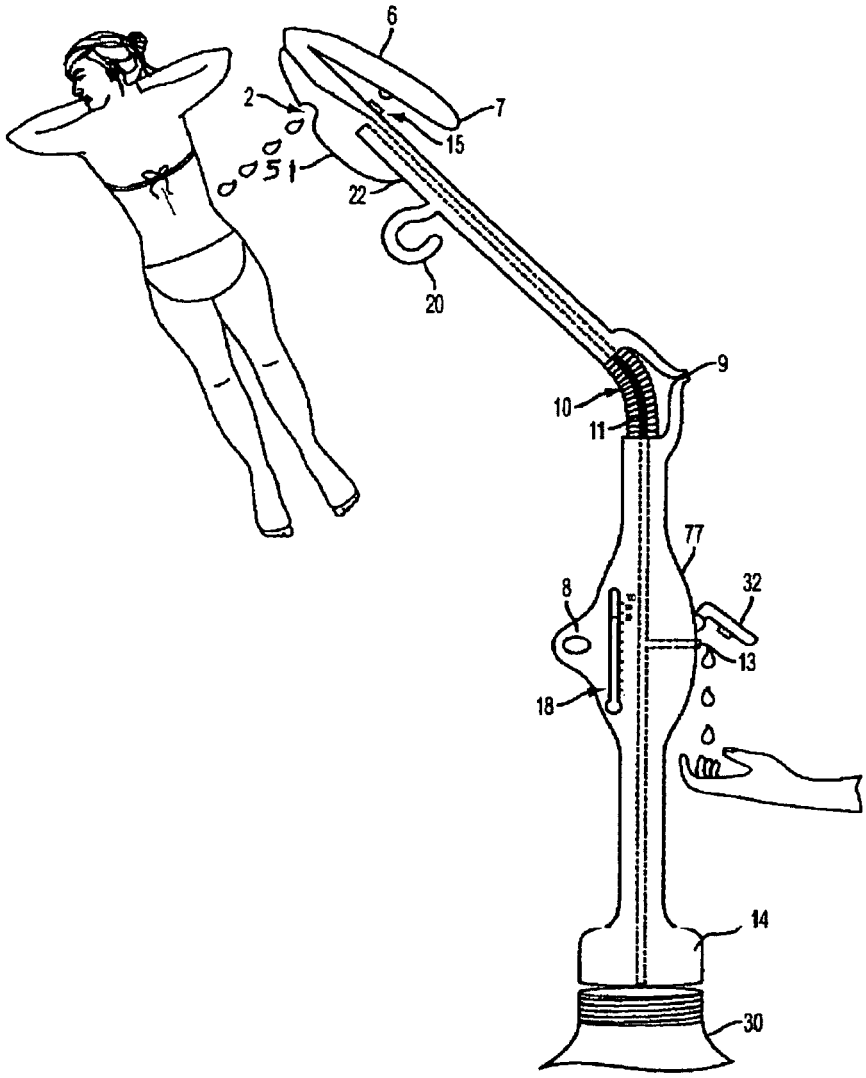
FIG. 2 is side view of a suntan oil applicator unfolded and assembled into a useable configuration and assembled onto a lotion bottle with the lower portion forming a handle and the upper portion with the applicator head pivotally extended at a select position.

FIG. 1 and FIG. 2 show the lotion applicator 55 having an elongated body 50 including a lower body potion 26 hingeably connecting to an upper body portion 24 including an applicator head portion 52 extending from the distal end thereof. The lower body portion 26 includes a means for connecting to a neck of a container or bottle such as by an overlapping collar 44 via a friction fit or more preferably with the distal end of the lower portion defining a collar having an internally threaded cap 14 of corresponding size and thread geometry for cooperatively engaging external threads extending around the neck of a bottle. At the center of the lower body portion a loop 8 may be provided for hooking to a hook 20 extending from the center of the upper body portion 24 providing means for holding the upper and lower portions in a folded collapsed space saving storage configuration, as shown in FIG. 1. One preferred embodiment provides a thermometer 18 affixed to an exterior surface near the center of lower body portion 26 which is a handy indicator of the outdoor temperature.

At least one embodiment includes an enlarged bulbous cavity 77 providing a reservoir for lotion held in the elongated lower body portion 26 of the applicator 55. Also located at or near the center of the lower body portion 26 is a nipple 13 which is in fluid communication with the lotion held in the hollow reservoir within the upper and lower body portions which also supply lotion to the applicator sponge head 52. A sample check valve or ball valve may be disposed between the collar 14 and bulbous area 77 of the lower portion to limit or stop the back flow of lotion from the applicator into the bottle. The lower potion 26 of the elongated applicator defines a handle 4.

Figure 4:
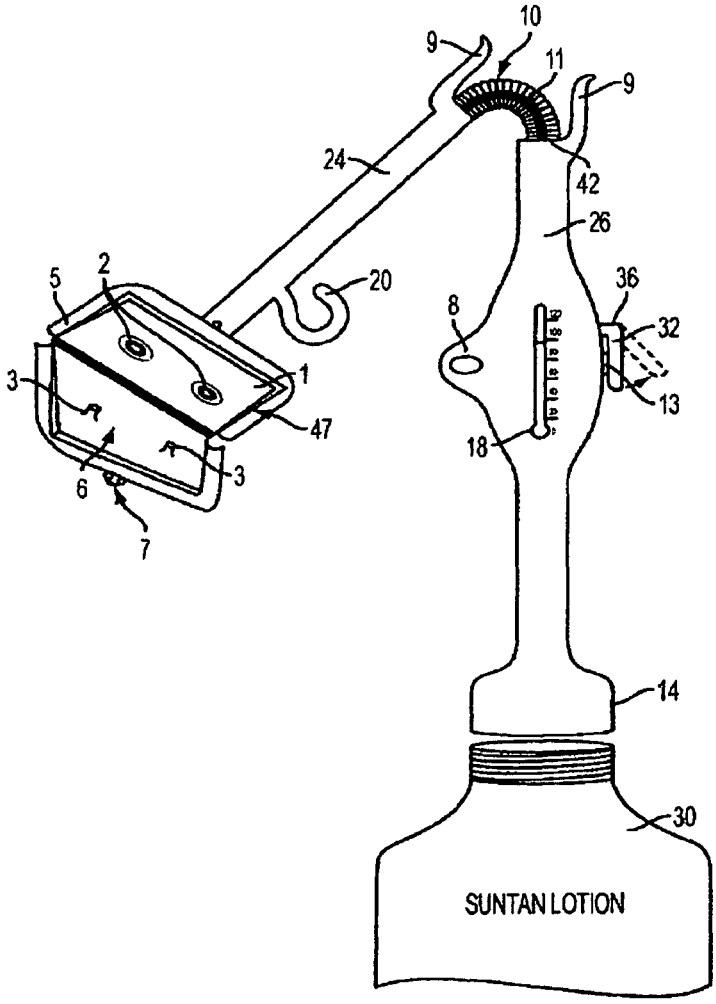
FIG. 4 is a perspective view of a suntan oil applicator including a spring coupling flexibly securing the lower body portion to the upper body portion and showing a threaded connection of a bottle neck.

As shown in FIGS. 1, 2 and 4, the lower portion 26 optionally includes a port, defining a collar or a nipple or nipple 13 extending from a central portion or bulbous portion 77 of the body which is in fluid communication with a lotion supply opening or lotion stored within the hollow tubular lower body portion 26. The nipple 13 is normally sealed of by closure 32 which defines a cap of flap closure which is attached to the exterior surface of the elongated lower body portion by a 'living hinge' member 36, which is merely a thin portion of plastic connecting closure 32 to lower body portion 26. When desired, closure 32 can be unsnapped from nipple 13 while applicator head 52 is closed, and bottle 30 may be squeezed to apply a desired amount of lotion onto a user's hand or wherever a user may desire.

A hollow spring means such as a helical spring 10 hingedly connects the upper body portion 24 to the lower body portion 26 of the elongated applicator. The spring surrounds a portion of a hose 11 which is exposed when the upper and lower portions of the applicator body are pivotally closed thus protecting and preventing crimping of the hose. The flexible spring connects the upper and lower portions of the applicator body together and supports the upper and lower portions together at selected positions (angles) upon extension.

The spring coupling means linking the upper portion and lower portion of the elongated body of the applicator is flexible to permit hinged and/or pivotal movement of the upper portion of the elongated body with the lower portion of the elongated body. One preferred embodiment of the spring coupling means links the upper portion and lower portion of the elongated body of the applicator wherein the spring is flexible and positionable whereby the spring can be bent at a desired angle in any direction. Furthermore, the spring may comprise a length of coiled steel tubing or strips of metal of plastic having the tensile strength to provide rigidity to the lotion applicator in the extended position and allow that the upper portion be bent and re-bent to selected positions and angles of less than 170 degrees.

The spring coupling means defining an elbow extends into and is secured inside or outside the distal end 42 of lower body portion 26. The other end of spring 10 extends into and is secured to the inside or outside of a proximal end 43 of upper body portion 24. The hose 11 extends two inches from the lower body portion 26 to the upper body portion 24 and is protected by spring 10.

Moreover, the lotion applicator may include holding means defining means for positioning or stop means defining projections or arch supports 9 extending from distal ends of the abutting lower and upper portions providing structural support and/or a stop means to the spring coupling means and providing means for holding the upper and lower portions at a selected obtuse angle position of less than 170 degrees in the in-use position.

Figure 3:
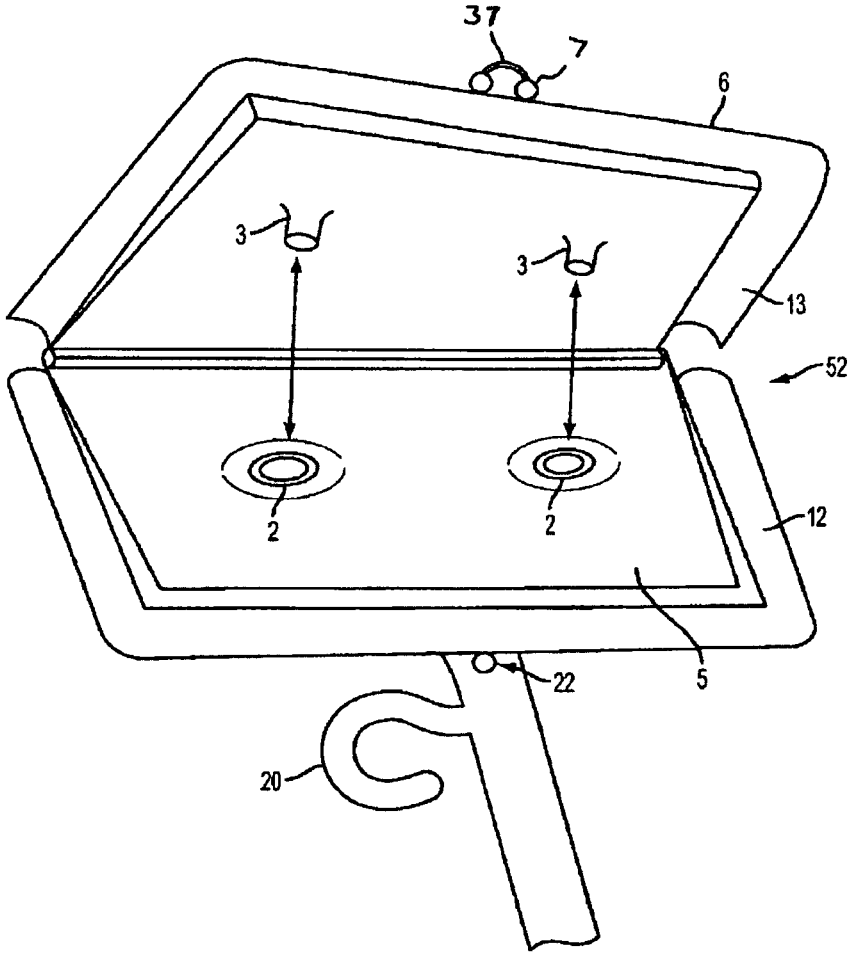
FIG. 3 is a perspective view of the sponge applicator head opened showing the base plate with rubber coated sponge, spreader cover and lotion outlets and corresponding applicator cap showing outlet plugs, and tongue and groove arrangement of the leak proof sealable sponge applicator head.

At the distal end of upper body portion 24 is the sponge applicator head 52. Applicator head 52 includes a convex or dome shaped base sponge 5 typically composed of a synthetic material such as a cellular foam or other type of open or closed cellular foam having a rubber or polymer coated surface covering the central face thereof forming a smooth surface. As shown in FIG. 3, the rubber or polymer coated sponge 5 attaches to a base plate 51. A cap or applicator cover 6 is hingedly connected to applicator base plate 51 by a hinge 34, which can be a 'living hinge' or another type of hinge such as a piano type hinge which may be selectively positionable.

The spreader 12 comprises a raised rounded rim or elongated ridge having a generally semicircular cross section providing a smooth surface elevated above the edge of the sponge 5 to aid in containing and distributing the lotion. The depressble convex sponge 5 extending from the interior surface of the base plate 51 contains at least one hole and preferably at least two holes, ducts, or pores 2 which are in fluid communication with fluid or lotion from the upper body portion by way of groove, duct, channel, bore, or porosity for the purpose of supplying lotion or oil to the sponge 5 when the bottle 30 or handle is squeezed. Corresponding sized and shaped elongated plugs 3 extending from the inside surface of the applicator cover penetrate and seal the holes 2 when the cap or cover 6 is rotated over and squeezed onto sponge 5.

The raised convex ridge shaped spreader 12 surrounds the convex sponge 5 attached to the base plate 51 at the outer marginal edges at the front and sides. The cap or applicator cover 6 includes a spreader cover 13 which has a shape corresponding to the shape of the spreader 12. Thus, the spreader cover defines a groove or trough generally semicircular in cross section which cooperatively receives the spreader 12 when the applicator head is in the closed position.

A snap closure includes a ball 22 attached to a proximal central marginal edge of base plate 51. A loop 37 extending from a portion of the upper body 24 having a pair of spaced apart corresponding closure balls 7 at each end of the loop is located at a distal central marginal outer edge of cap 6. When the cap 6 is urged closed, the closure ball 22 snaps through the pair of corresponding spaced apart balls 7 and releaseably holds the cap 6 in a closed condition. Another embodiment shown in FIG. 2 has a closure ball 22 and a mating snap balls 7 in opposite locations for providing the same function. As shown in FIG. 1, the outer side of cap 6 contains a male snap closure 16 and the distal outer side of upper body portion 24 contains a mating female closure 15 which can fixedly receive male snap closure 16 when a user urges cap 6 completely open. Therefore, female closure 15 forms a friction fit with male closure 16 to forcibly hold cap 6 open.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplification presented herein above. Rather, what is intended to be covered is within the spirit and scope of the appended claims.

I claim:

1. A lotion applicator consisting essentially of:

a lower body portion having a hollow interior defining a lower conduit hingedly connecting to an upper body portion having a hollow interior defining an upper conduit and having an applicator head extending therefrom;

a tube connecting lower conduit to said upper conduit;

a helical spring coupling extending from and connecting said lower body portion to said upper body portion for positioning said upper body portion at a selected obtuse angle of less than 170 degrees with respect to said lower body portion;

said tube extending coaxially through said helical spring coupling; said applicator head including a base plate having a base sponge having a smooth surface, said base sponge having at least one aperture formed therein in fluid communication with said upper conduit;

said applicator head including a spreader extending around the marginal edge of at least a portion of said base plate, said spreader comprising an elongated raised ridge having a smooth rounded cross-sectional area;

said applicator base including a groove around the periphery thereof disposed between said sponge and said spreader;

said applicator head including a cover cap hingedly attached to a distal marginal edge of said base plate, said covercap including a rim forming a tongue around the peripheral edge thereof, said tongue of a corresponding size and shape to cooperatively engage said ridge of said base plate forming a leak tight seal when said cover cap is closed against said base plate of said applicator head;

said cover including a pair of snap lock balls extending from a distal marginal edge thereof;

said upper body having a loop extending from a portion thereof and capable of having said balls snapped there into for fixedly holding said cover against said base plate for releaseably engaging a corresponding snap ball projecting from a marginal edge of said base plate; said cover containing at least one mating plug capable of scaling engagement with at least one aperture within said base sponge for holding said lotion within said aperture upon closure of said cap with said base plate;

and said upper body portion having a ball receiving socket on an exterior surface side opposite to said base sponge and said cover having a ball extending outward from an exterior surface side opposite to said at least one plug, said ball positioned to snap into said socket upon rotating said cover on said hinge for holding said cover in a fully open position; said lower body portion including a means of attachment to a neck of a bottle;

said lower body portion including a lower loop extending from a selected position;

said upper body portion including a hook extending from a selected position for releaseably engaging said lower loop capable of capturing said hook for holding said applicator in a folded storage configuration;

said lower body portion including a nipple extending from a selected position thereof in fluid communication with said lower conduit and a cap hingedly connecting said lower body portion for closing and sealing said nipple.

2. The suntan lotion applicator defined in claim 1 including a thermometer affixed to the lower body portion.

3. The suntan lotion applicator defined in claim 1 wherein said means of attachment comprising an expandable collar extending from the distal end of the lower body portion.

4. A lotion applicator consisting essentially of:

a lower body portion and an upper body portion each one having a hollow conduit disposed therethrough, said lower body portion including a distal end defining a threaded cap portion at a proximal end thereof, said threaded cap portion including internal threads sized to fit a neck of a lotion bottle having exterior threads of a corresponding size for cooperative sealable engagement thereof;

said lower body portion having a nipple extending from a selected portion thereof, said nipple being in fluid communication with said conduit therein and having a cap hingedly and releaseably covering and sealing said nipple;

a tube in fluid communication with and joining said conduit of said lower body portion and said upper body portion;

a helical spring coupling extending from and connecting said lower body portion to said upper body portion for positioning said upper body portion at a selected obtuse angle of less than 170 degrees with respect to said lower body portion; said tube extending coaxially through said helical spring coupling;

said applicator head including a base plate having a convex rubber coated base sponge having a smooth surface, said base sponge having a pair of aperture formed therein in fluid communication with said upper conduit;

said applicator head including a spreader extending around the marginal edge of at least a portion of said base plate, said spreader comprising an elongated raised ridge having a smooth rounded cross-sectional area;

said applicator base including a groove around the periphery thereof disposed between said sponge and said spreader; said applicator head including a cover cap hingedly attached to a distal marginal edge of said base plate, said covercap including a rim forming a tongue around the peripheral edge thereof, said tongue of a corresponding size and shape to cooperatively engage said ridge of said base plate forming a leak tight seal when said cover cap is closed against said base plate of said applicator head;

said cover including a pair of snap lock balls extending from a distal marginal edge thereof;

said upper body having a loop extending from a portion thereof and capable of having said balls snapped there into for fixedly holding said cover against said base plate for releaseably engaging a corresponding snap ball projecting from a marginal edge of said base plate;

said cover containing a pair of mating plugs capable of sealing engagement with said pair of apertures disposed within said base sponge for holding said lotion within said aperture upon closure of said cap with said base plate;

and said upper body portion having a ball receiving socket on an exterior surface side opposite to said base sponge and said cover having a ball extending outward from an exterior surface side opposite to said at least one plug, said ball positioned to snap into said socket upon rotating said cover on said hinge for holding said cover in a fully open position;

said lower body portion including a lower loop extending from a selected position;

said upper body portion including a hook extending from a selected position for releaseably engaging said lower loop capable of capturing said hook for holding said applicator in a folded storage configuration;

and said lower body portion including a nipple extending from a selected position thereof in fluid communication with said lower conduit and a cap hingedly connecting said lower body portion for closing and sealing said nipple.

5. A lotion applicator consisting of:

a lower body portion having a hollow interior defining a lower conduit hingedly connecting to an upper body portion having a hollow interior defining an upper conduit and having an applicator head extending therefrom;

a tube connecting lower conduit to said upper conduit;

a helical spring coupling extending from and connecting said lower body portion to said upper body portion for positioning said upper body portion at a selected obtuse angle of less than 170 degrees with respect to said lower body portion;

said tube extending coaxially through said helical spring coupling; said applicator head including a base plate having a base sponge having a smooth surface, said base sponge having at least one aperture formed therein in fluid communication with said upper conduit;

said applicator head including a spreader extending around the marginal edge of at least a portion of said base plate, said spreader comprising an elongated raised ridge having a smooth rounded cross-sectional area;

said applicator base including a groove around the periphery thereof disposed between said sponge and said spreader;

said applicator head including a cover cap hingedly attached to a distal marginal edge of said base plate, said covercap including a rim forming a tongue around the peripheral edge thereof, said tongue of a corresponding size and shape to cooperatively engage said ridge of said base plate forming a leak tight seal when said cover cap is closed against said base plate of said applicator head;

said cover including a pair of snap lock balls extending from a distal marginal edge thereof;

said upper body having a loop extending from a portion thereof and capable of having said balls snapped there into for fixedly holding said cover against said base plate for releaseably engaging a corresponding snap ball projecting from a marginal edge of said base plate;

said cover containing at least one mating plug capable of sealing engagement with at least one aperture within said base sponge for holding said lotion within said aperture upon closure of said cap with said base plate;

and said upper body portion having a ball receiving socket on an exterior surface side opposite to said base sponge and said cover having a ball extending outward from an exterior surface side opposite to said at least one plug, said ball positioned to snap into said socket upon rotating said cover on said hinge for holding said cover in a fully open position; said lower body portion including a means of attachment to a neck of a bottle;

said lower body portion including a lower loop extending from a selected position; said upper body portion including a hook extending from a selected position for releaseably engaging said lower loop capable of capturing said hook for holding said applicator in a folded storage configuration;

said lower body portion including a nipple extending from a selected position thereof in fluid communication with said lower conduit and a cap hingedly connecting said lower body portion for closing and sealing said nipple.

* * * * *